United States Patent [19]

Bulman et al.

[11] Patent Number: 4,945,809

[45] Date of Patent: Aug. 7, 1990

[54] LIQUID PROPELLANT GUN

[75] Inventors: Melvin J. Bulman, Shelburne; David L. Maher, Winooski, both of Vt.

[73] Assignee: General Electric Company, Pittsfield, Mass.

[21] Appl. No.: 677,151

[22] Filed: Nov. 30, 1984

[51] Int. Cl.[5] ..... F41D 11/24; F41F 1/04

[52] U.S. Cl. ..... 89/7; 102/440

[58] Field of Search ..... 89/7, 8; 102/430, 440

[56] References Cited

U.S. PATENT DOCUMENTS

| | | | |
|---|---|---|---|
| 2,922,341 | 1/1960 | Treat, Jr. | 89/7 |
| 2,981,153 | 4/1961 | Wilson, Jr. et al. | 89/7 |
| 2,986,072 | 5/1961 | Hudson | 89/7 |
| 3,138,990 | 6/1964 | Jukes et al. | 89/7 |
| 3,690,255 | 9/1972 | Vass et al. | 102/39 |
| 3,763,739 | 10/1973 | Tassie | 89/7 |
| 3,783,737 | 1/1974 | Ashley | 89/7 |
| 4,023,463 | 5/1977 | Tassie | 89/7 |
| 4,033,224 | 7/1977 | Holtrop | 89/7 |
| 4,069,739 | 1/1978 | Ashley | 89/1.704 |
| 4,160,405 | 7/1979 | Ayler et al. | 89/7 |
| 4,281,582 | 8/1981 | Jaqua | 89/7 |
| 4,336,741 | 6/1982 | Baines | 89/7 |
| 4,341,147 | 7/1982 | Mayer | 89/7 |
| 4,523,508 | 6/1985 | Mayer et al. | 89/7 |
| 4,586,422 | 5/1986 | Magoon | 89/7 |

FOREIGN PATENT DOCUMENTS

| | | | |
|---|---|---|---|
| 1501852 | 2/1978 | United Kingdom | 89/7 |
| 1501853 | 2/1978 | United Kingdom | 89/7 |

OTHER PUBLICATIONS

Final Report of Nov. 19, 1953 through Jan. 31, 1956 under Contract DA-36-034-ORD-1504RD, Project TS1-47-8 by V. M. Barnes, Jr., et al.

Report No. 17-2 of Jun. 15, 1954 under Contract NOrd-10448 by C. R. Foster et al.

Final Report of Sep. 1, 1957 under Contract NORD 16217, Task 1 by L. C. Elmore et al.

"Direct Injection Liquid Propellant Gun Technology" by Penn, Campbell and Bulman, CPIA Publication 280, Jun. 1977, pp. 257-303.

*Primary Examiner*—David H. Brown

*Attorney, Agent, or Firm*—Bailin L. Kuch

[57] ABSTRACT

This invention provides an annular piston, annular control valve, liquid propellant gun system, having a dual angle injection mechanism to provide both bore and chamber gas requirements with a single injection control valve. The dual angle feature assures a stable combustion zone. A flexible lip on the projectile is used in conjunction with the dual angle injection mechanism to positively eliminate backflow of propellant through the injection mechanism during the ignition phase of the gun cycle.

4 Claims, 1 Drawing Sheet

LIQUID PROPELLANT GUN

BACKGROUND OF THE INVENTION

1. Field of the Invention

This invention relates to liquid propellant guns utilizing a differential piston to provide continued or regenerative injection of propellant into the combustion chamber.

2. Prior Art

This invention is an improvement of the invention disclosed in Ser. No. 840,074, filed Oct. 6, 1977, now abandoned, by M. Bulman, which discloses a liquid propellant gun system having an annular differential piston journaled for telescopic movement with respect to an annular control valve and to the chamber of the firing bore.

The invention is furthermore an improvement of the invention disclosed in Ser. No. 178,254, filed Aug. 7, 1980, by M. Bulman, which in an annular piston, annular control valve, liquid propellant gun, discloses a check valve to permit liquid propellant under relatively low pressure to flow from the supply system into the combustion chamber and to preclude the pulse of pressure generated in the combustion chamber from feeding back to the supply system.

Reference should be made to Ser. No. 840,074 and Ser. No. 178,254, hereby incorporated by reference, for structure not shown in this disclosure.

SUMMARY OF THE INVENTION

An object of this invention is to simplify the injection mechanism for an annular piston, annular control valve gun system.

A feature of this invention is the provision in an annular piston, annular control valve, liquid propellant gun system, of a dual angle injection mechanism to provide both bore and chamber injection, which employs a single injection control valve. A flexible lip on the projectile is used in conjunction with the dual angle injection mechanism to positively eliminate backflow of propellant through the injection mechanism during the ignition phase of the gun cycle.

BRIEF DESCRIPTION OF THE DRAWING

These and other features and advantages of the invention will be apparent from the following description of the invention taken in conjunction with the accompanying drawing in which.

DESCRIPTION OF THE INVENTION

Figure 1:
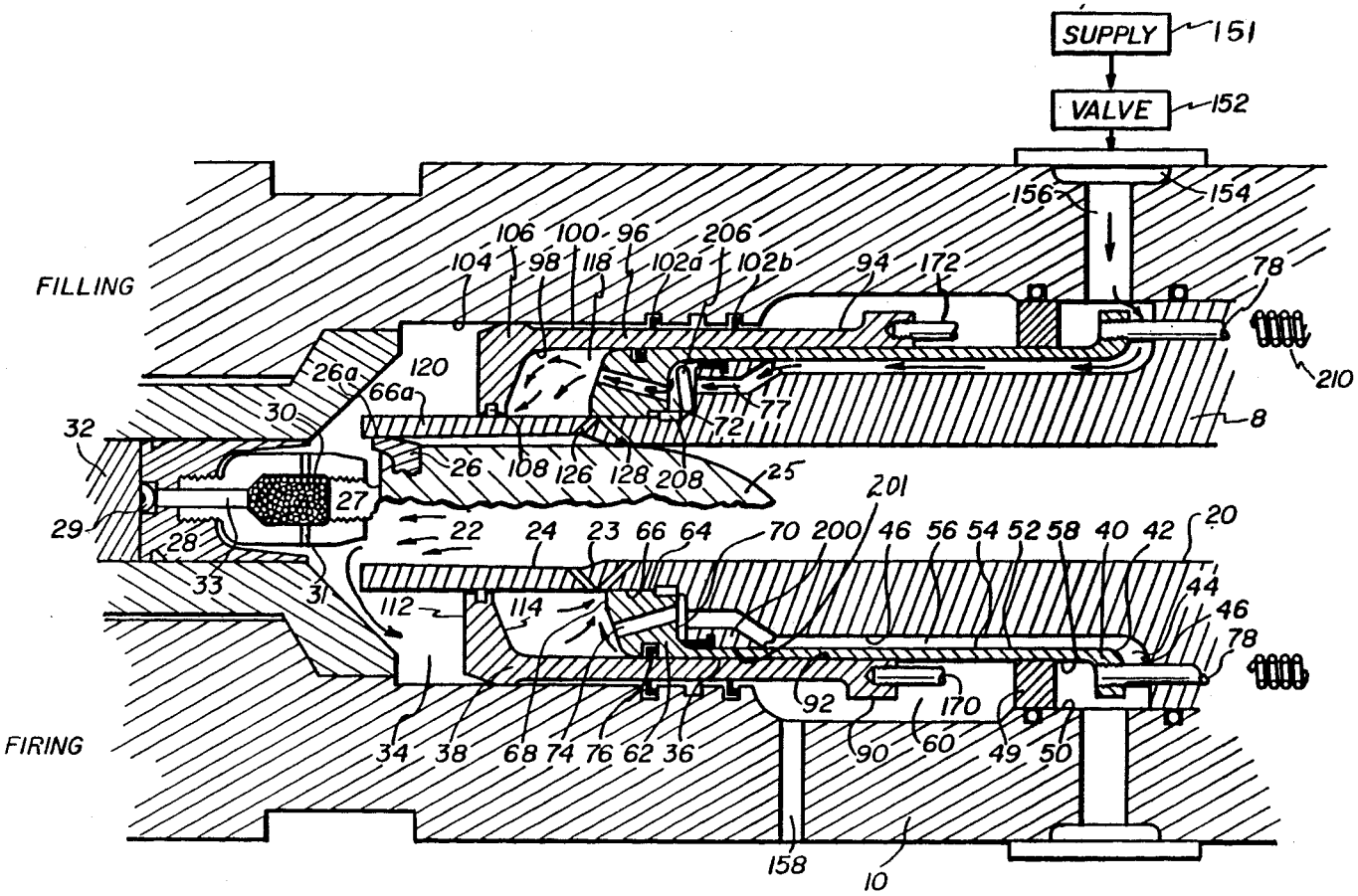
FIG. 1 is a view in elevation, in longitudinal cross-section, of a gun system embodying this invention. The upper half of the view shows the assembly during the filling with liqiud propellant, while the lower half shows the assembly after filling and during firing.

The gun system includes a gun barrel assembly 8 which is fixed within a housing 10. The barrel assembly has a rifled firing bore 20, a projectile receiving chamber 22 having an intermediate forcing cone 23 and a cylindrical surface 24. A round of ammunition comprising a projectile 25 with a firing band 26 having an aftwardly-outwardly projecting deflectable lip **26*a* which is fixed by a frangible threaded tube 27 to a stub case 28 which has a percussion primer 29 and a booster charge 30. The round is chambered, locked and extracted by a conventional bolt 32, or, in a large caliber gun, a breech block. The booster has a plurality of gas vents 31 for the booster charge, which is ignited by the primer 29 via a bore 33**.

The barrel assembly and the housing 10 define a substantially hollow cylindrical cavity 34 in which are telescopically disposed a substantially hollow cylindrical valve 36 and a substantially hollow cylindrical piston 38.

The valve 36 includes a forward annular portion 40 having an inner wall surface 42 providing an annular gap or passageway 44 adjacent the outer wall surface 46 of the barrel. The annular portion 40 is integral with an intermediate tubular portion 52 having an inner wall surface 54 providing an annular cavity 56 adjacent the outer wall surface 46, and an outer wall surface 58 providing an annular cavity 60 adjacent the inner wall surface 50 of the housing. The intermediate portion 52 is integral with an aft annular portion 62 having an inner wall surface 64 journaled on the outer wall surface 66 of the barrel and substantially sealed thereto, a transverse aft surface 68, a transverse forward surface 70, an inner annular cavity 72, a plurality of longitudinal bores or passageways 74 extending between the surfaces 68 and 70, and a ring seal 76 disposed in an annular groove in the outer wall surface 58. A plurality of longitudinal bores 77 provide passageways between the cavity 56 and the cavity 72 when the valve 36 is aft of its forwardmost position. Two rods 78 have their aft ends respectively fixed to the forward annular portion 40, and pass through bores in the housing. The rods are each biased aftwardly by a respective helical compression spring 210 captured between a cross pin on the rod and a plug in the housing. Each rod may have a respective seal as shown in Ser. No. 840,074, and has a detent mechanism to preclude aftward movement of the valve beyond that shown in the upper part of FIG. 1.

The piston 38 includes a forward annular portion 90 having an inner wall surface 92 journaled on the surface 58 of the valve and an outer wall surface 94 spaced from the surface 50 of the housing. The annular portion 90 is integral with an intermediate tubular portion 96 having an inner surface 92 bearing against the ring seal 76 in the valve, and an outer surface 100 bearing against a pair of ring seals **102*a* and 102*b* respectively disposed in a pair of annular grooves in the inner surface 104 of the housing. The intermediate portion 96 is integral with an aft annular portion 106 having mounted thereon a ring seal 108, which may be a discrete seal as shown or simply a tight clearance, which is biased to journal on and seal against the aftmost portion 66*a* of the outer surface 66 of the barrel. It will be seen that the effective cross-sectional area of the forward surface 114 of the aft annular portion 106 is less than the effective cross-sectional area of the aft surface 112, providing the piston 38** with a differential piston action.

The barrel 8, the valve 36 and the piston 38, depending on their mutual positioning, may be considered to define a liquid propellant fill cavity 56, a valve cavity 72, a pumping cavity 118, and a combustion cavity 120. The barrel 8 has a first plurality of bores 126 disposed in an annular row and angled aftwardly from the surface 66 in the pumping chamber 118 to the surface 24 in the projectile chamber 22. The barrel 8 has a second plurality of bores 128 disposed in an annular row and angled forwardly from the surface 66 in the pumping chamber 118 to bore 20. The bores 126 and 128 are herein shown at an angle of 45°.

A supply means 151 for supplying liquid propellant under pressure is coupled to a cam controlled valve 152 which is coupled to an inlet in the housing which leads to an annular passageway 154 in the housing, from which a plurality of radial bores 156 lead to and through the forward portion of the surface 50. A radial bore 158 leads through and from the surface 50 aft of the annulus 90 of the piston 38 to a vent.

Two rods 170 and 172 have their aft ends respectively fixed to the forward annular portion 90 of the piston 38, and pass through bores with seals in the housing. The forward ends of the rods respectively terminate in an enlargement. A drum cam, such as is shown in U.S. Pat. No. 3,763,739, issued Oct. 9, 1973, to D. P. Tassie, has a helical control track in which rides a cam follower which has an arm which terminates in a rod follower. The rods are free to move forwardly free of the follower, but are controlled in their movement aftwardly by the cam track via the followers. The cam track is also able to pull the rods forwardly via the followers, all as shown in Ser. No. 840,074.

The barrel 8 has an enlarged portion 200 with an outer surface 201 which rides on and serves to seal against the inner surface 54 of the valve 36. A plurality of substantially longitudinal bores 77 are disposed in an annular row through the enlargement to serve as passageways from the fill annular cavity 56 to the valve cavity 72. The plurality of longitudinal bores 74 serve as passageways from the valve cavity 72 to the pumping cavity 118.

A belleville washer 206 is seated in the valve cavity 72 on the barrel adjacent the bores 77 and retained by a retaining ring 208. The washer is normally conical in shape and permits the flow of liquid propellant from the fill cavity 56, through the passageways 77, around the washer 206, through the valve cavity 72, and through the passageways 74 into the pumping cavity 118. Prior to firing, the differential valve 36 is held in the position shown in the upper portion of FIG. 1 by means of external compression springs 210 coupled to the rods 78, so that the surface 66 of the valve head 62 closes both rows of bores 126 and 128 and precludes the flow of liquid propellant from the pumping cavity 118 into these bores. At the beginning of firing, the liquid pressure in the pumping cavity 118 will rise and be communicated to the valve cavity 72. This increase in pressure on the aft face of the belleville washer 206 over the pressure on the forward face of washer will force the washer flat against its inherent spring force to close the passageways 77, to thereby isolate the fill cavity 56 and its anterior system from the ballistic fluid pressures generated during the firing. During firing, because the forward face 70 of the head of the valve 36 has less transverse area than the aft face 68, the differential pressure generated thereby will progressively force the valve 36 forward, against the bias of the springs 210, to progressively reduce the volume of the valve cavity 72 to substantially zero and to progressively uncover the aftwardly directed bores 126 and the forwardly directed bore 128.

In the embodiment here shown, firing is initiated by a mechanical firing pin in the gun bolt 32 impacting the primer 29 to generate and pass hot gas under high pressure through the passageway 33 to the booster charge 30, which in turn generates hot gas under pressure which is passed through the vents 31 into the combustion cavity 120. This gas under pressure will act on the aft face 112 of the head 106 of the piston 38 to force the piston forwardly, increasing the pressure in the pumping cavity 118 on the aft face 68 of the head 62 of the valve 36, and in the valve cavity 72. The belleville washer 206 closes the passageways 77 and the valve 36 commences to move forwardly. As the valve 36 moves forwardly it uncovers the bores 126 which pass liquid propellant into the annular cavity defined by the projectile, the surface 24, the forcing cone 23 and the lip **26*a* of the firing band 26. The lip seals the annular cavity, blocking back pressure developed in the combustion cavity 120 from entering this annular cavity and the upstream liquid propellant supply system. As the pressure increases in the pumping cavity 118, the lip 26*a* is deflected to pass liquid propellant aftwardly of the projectile into the combustion cavity 120. Because the forward face 114 of the piston head has less transverse area than the aft face 112, the differential pressure generated will force the piston forwardly continuing the flow of liquid propellant through the bores 126. At a predetermined gas pressure in the combustion chamber 120, e.g., 5,000 psi, the frangible tube 27 will break and the projectile will be free to ride forwardly into the gun barrel bore to uncover the bores 128. Since the valve head 62 has already uncovered these bores, liquid propellant is now free to pass from the pumping cavity 118** through these bores forwardly into the gun barrel bore to provide a spray of liquid propellant into the gun barrel which then burns due to contact with hot combustion gasses. Throughout the injection phase, chamber gas flow is provided by the aft angled holes and bore gas flow is provided by the forward angled holes.

The dual angle feature of this injector dispurses the separate injection streams and avoids the accumlation of an unstable quantity of unburned propellants.

In the event of a misfire, both the differential valve 36 and the belleville washer valve will remain in their initial, open dispositions, to permit the liquid propellant in the pumping cavity 118 to be returned to the supply system 151 by the process of moving the differential piston forwardly via the rods 170 and 172.

What is claimed is:

1. A liquid propellant gun system comprising:

a housing having a longitudinally extending first cavity, therein;

a gun barrel having a longitudinal axis and a firing bore with a projectile receiving chamber and a combustion chamber disposed along said longitudinal axis;

a projectile disposed in said projectile receiving chamber;

said gun barrel being disposed within said housing first cavity and with said housing defining a second closed cavity which is a portion of said first cavity and is of substantially annular, longitudinally extending shape and is coaxial with said barrel longitudinal axis;

a valve of substantially annular, longitudinally extending shape coaxial with said barrel longitudinal axis and disposed in said second cavity;

a piston of substantially annular, longitudinally extending shape coaxial with said barrel longitudinal axis and disposed in said second cavity;

said piston and said valve being journaled for relative motion with respect to each other and said gun barrel, said piston and said valve mutally defining a pumping chamber of variable volume for liquid propellant;

obturating means for closing the aft end of said projectile receiving chamber;

supply means for supplying liquid propellant under pressure; and first and second conduit means for coupling said pumping chamber to said projectile receiving chamber;

additional valve means disposed on said projectile when under relatively low pressure for precluding the flow of liquid propellant from said projectile receiving chamber into said combustion chamber and when under relatively higher pressure for permitting the flow of liquid propellant from said projectile receiving chamber into said combustion chamber.

2. A gun according to claim 1 where first conduit means is angled aft and second conduct means is angled forward.

3. A liquid propellant gun system comprising:

a housing, a gun barrel, a differential annular valve, a differential annular piston, said housing, barrel, valve and piston defining a fill chamber, a pumping chamber, a projectile receiving chamber, and a combustion chamber, a projectile disposed in said projectile receiving chamber, and valve means, disposed in part on said projectile, when under relatively low pressure for precluding the flow of liquid propellant from said pumping chamber into said combustion chamber and when under relatively higher pressure for permitting the flow of liquid propellant from said pumping chamber into said combustion chamber.

4. A gun system according to claim 3 wherein:

said valve means comprises an annular seal means which seals said projectile to said projectile receiving chamber at relatively low pressure and which opens at relatively higher pressure to provide an annular gap between said projectile and said projectile receiving chamber.

* * * * *